US011629591B2

(12) United States Patent
Pelletier et al.

(10) Patent No.: US 11,629,591 B2
(45) Date of Patent: Apr. 18, 2023

(54) FORMATION TEST PROBE

(71) Applicant: Halliburton Energy Services, Inc., Houston, TX (US)

(72) Inventors: Michael T. Pelletier, Houston, TX (US); Darren Gascooke, Houston, TX (US); Li Gao, Katy, TX (US); Christopher W. Berry, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 449 days.

(21) Appl. No.: 16/841,249

(22) Filed: Apr. 6, 2020

(65) Prior Publication Data

US 2021/0310352 A1 Oct. 7, 2021

(51) Int. Cl.

| | |
|---|---|
| ***E21B 49/00*** | (2006.01) |
| ***E21B 49/10*** | (2006.01) |
| ***E21B 49/08*** | (2006.01) |

(52) U.S. Cl.

CPC ..... *E21B 49/008* (2013.01); *E21B 49/003* (2013.01); *E21B 49/088* (2013.01); *E21B 49/10* (2013.01)

(58) Field of Classification Search

CPC ..... E21B 49/008; E21B 49/088; E21B 49/10
See application file for complete search history.

(56) References Cited

U.S. PATENT DOCUMENTS

| | | | | |
|---|---|---|---|---|
| 3,530,933 | A * | 9/1970 | Whitten | E21B 49/10 166/100 |
| 4,828,052 | A | 5/1989 | Duran et al. | |
| 5,269,180 | A * | 12/1993 | Dave | E21B 49/088 73/152.52 |
| 5,456,325 | A * | 10/1995 | Pantermuehl | E21B 7/24 175/6 |
| 6,880,402 | B1 * | 4/2005 | Couet | G01N 29/036 73/1.49 |
| 6,968,910 | B2 * | 11/2005 | Bar-Cohen | E21B 7/24 175/249 |
| 7,331,223 | B2 | 2/2008 | Zazovsky | |
| 7,426,968 | B2 * | 9/2008 | Hall | E21B 10/62 175/50 |
| 7,497,256 | B2 | 3/2009 | Difoggio et al. | |

(Continued)

OTHER PUBLICATIONS

Definition & Introduction of Ultrasonic Machining, Wikipedia, retrieved online Sep. 17, 2019, https//en.wikipedia.org/wiki/Ultrasonic_machining.

(Continued)

*Primary Examiner* — Jonathan Malikasim
(74) *Attorney, Agent, or Firm* — Delizio, Peacock, Lewin & Guerra

(57) ABSTRACT

A formation test probe and a formation test system and method for implementing a self-drilling probe are disclosed. In some embodiments, a test probe includes a body having a channel therethrough to a frontside port, and further includes drill-in tubing disposed within the channel and having a front tip that is extensible from the frontside port. An exciter is disposed within the body in contact with the drill-in tubing and operably configured to induce resonant vibration in the drill-in tubing during a drill-in phase of a formation test cycle.

25 Claims, 7 Drawing Sheets

(56) References Cited

U.S. PATENT DOCUMENTS

| | | | | |
|---|---|---|---|---|
| 7,963,319 | B2 * | 6/2011 | Daigle | E21B 29/04 166/54.5 |
| 8,950,484 | B2 | 2/2015 | Sherrill | |
| 8,991,245 | B2 | 3/2015 | Fields et al. | |
| 9,163,500 | B2 * | 10/2015 | Tao | E21B 17/1014 |
| 9,359,891 | B2 | 6/2016 | Galvan-Sanchez et al. | |
| 9,982,487 | B2 | 5/2018 | Samuel et al. | |

OTHER PUBLICATIONS

PCT Application Serial No. PCT/US2020/026897, International Search Report, dated Jan. 5, 2021, 3 pages.
PCT Application Serial No. PCT/US2020/026897, International Written Opinion, dated Jan. 5, 2021, 8 pages.

* cited by examiner

FORMATION TEST PROBE

BACKGROUND

The disclosure generally relates to the field of formation testing and more particularly to formation tests probes and to systems and methods for using formation test probes.

A variety of formation testing systems, components, and techniques are utilized for measuring, detecting, or otherwise determining formation properties. Drill stem testing (DST) is a category of formation testing typically utilized to determine near-field and far-field formation rock permeability, production capacity, and other properties of a formation during and/or following drilling a borehole. A DST apparatus includes components for measuring or otherwise determining formation permeability, structures and in situ fluid compositional properties using pressure transient analysis (PTA). PTA testing entails pressure isolating one or more subsections, or zones, of an open or cased borehole (either may be referred to herein as a wellbore) and performing pressure and fluid composition testing within and sometimes proximate to the isolated zone(s).

DST systems require investment in large-scale equipment for testing and disposing of the large quantities of wellbore fluids that result from the testing. So-called mini-DSTs may be implemented using smaller scale equipment such as a formation test tool deployed via wireline to more quickly and inexpensively determine formation and fluid properties. Such smaller scale formation test tools may utilize formation test probes that extend and seat on a wellbore surface to collect fluid samples and perform fluid pressure testing.

BRIEF DESCRIPTION OF THE DRAWINGS

Embodiments of the disclosure may be better understood by referencing the accompanying drawings.

DESCRIPTION

Figure 1:
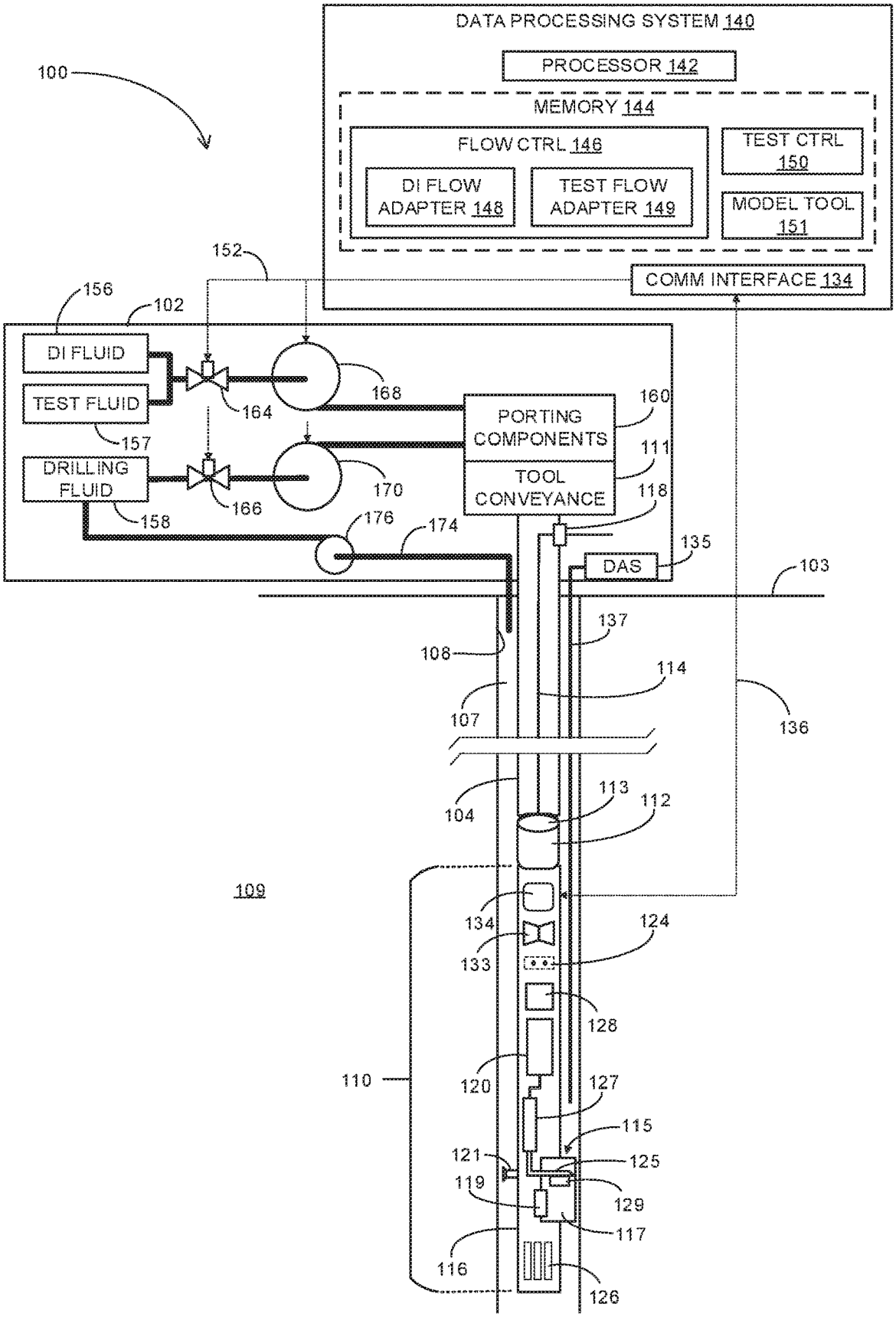
FIG. 1 is a conceptual diagram depicting a formation test system in accordance with some embodiments.

The description that follows includes example systems, methods, techniques, and program flows that exemplify embodiments of the disclosure. However, it is understood that this disclosure may be practiced without these specific details. In other instances, well-known instruction instances, protocols, structures and techniques have not been shown in detail to avoid obfuscating the description.

Overview

Disclosed embodiments include downhole test tools, probes and other systems, devices, components, and techniques for performing formation tests. Formation testing may include material sampling tests and fluid pressure tests that entail contacting the surface layers of a wellbore to draw fluid from and inject fluid into a formation. In some embodiments, a formation test tool includes a self-drilling probe configured to bore into material layers of a wellbore without requiring the substantial operating overhead required for standard inflow type drill stem tests (DSTs). The self-drilling probe also addresses wellbore contamination and sub-optimal formation contact issues that affect formation testing in which self-sealing probes are used to withdraw formation fluids from a wellbore surface.

In some embodiments, a self-drilling probe is deployed as part of a wireline test tool that is extended downhole to one or more test positions along a wellbore. In other embodiments, a self-drilling probe is deployed within a test collar of a drill string bottom hole assembly (BHA) and extended downhole as part of the drill string to one or more test positions. BHA generally refers to a string of one or more components attached at or near the lower end of a test string having a conduit through which fluids may be transported from surface to downhole or from downhole to surface. Deployed within a BHA or otherwise in a drill string, the formation test tool may be operated as a logging while drilling (LWD) or measuring while drilling (MWD) tool. While embodiments may be performed using a drill string and/or a wireline assembly, the formation test tool may be configured in a variety of deployment options including coiled tubing.

A downhole test tool includes a probe comprising components configured to drill or otherwise bore through a mud cake (also referred to as filter cake) layer on the wellbore wall. For example, the probe may include a body having a channel in which drill-in tubing is disposed. In some embodiments, a formation test cycle begins with the formation test tool being positioned proximate to a test position at a point along the wellbore such as via drill string or wireline positioning. During the test cycle, a probe actuator within the test tool extends the probe outwardly toward a wellbore surface on which the probe seats. During a drill-in phase of the test cycle, a tubing actuator extends a front tip of the drill-in tubing through a frontside port of the probe body. In some embodiments, the front tip of the drill-in tubing is extended through a mud cake layer and into formation material. The drill-in tubing may be extended until the front tip has passed through the mud cake and into the formation at a depth at which filtrate contamination is minimal.

During the drill-in phase, an exciter within the probe induces a vibration, such as a resonant vibration, in the drill-in tubing to facilitate drilling/boring into and through mud cake and formation material. The exciter incudes a vibration source, such as a piezoelectric transducer, that generates an acoustic vibration such as an ultrasonic vibration. The exciter may further include an acoustic transmission horn (acoustic horn) contacting the vibration source and that is otherwise configured to transmit and translate the acoustic vibration into a corresponding acoustic vibration of the front tip of the drill-in tube. The acoustic vibration may be modulated such as via a signal input to the vibration source based on a determined material resistance detected at or proximate to the front tip of the drill-in tube during the drill-in phase.

In some embodiments, a drill-in fluid is pumped into or otherwise applied within the drill-in tubing during the drill-in phase. The drill-in fluid may be pressurized by downhole and/or surface flow control devices based on the pliability of the material of which the drill-in tubing is constructed to provide additional rigidity to the drill-in tubing. During the drill-in phase and/or during a subsequent formation test phase, the fluid pressure within the drill-in tubing may be modulated based on formation fluid backpressure.

A drill-in phase ends with the front tip of the drill-in tubing disposed within formation material and in some cases beyond a filtrate invasion zone. The extended drill-in tubing bypasses non-native fluid permeability barriers (e.g., mud cake, invasion zone) and provides an unobstructed conduit for fluid flow to and from the formation during a formation test phase. To implement formation testing, the test tool further includes flow control components configured to perform fluid intake and fluid injection operations and measurement components to determine fluid properties such as temperature, pressure, and fluid composition.

A formation test phase may begin with fluid inflow sampling and testing in which fluid is withdrawn into the test tool and various fluid and flow properties measured. During and following inflow testing, measurement components are utilized to determine fluid properties such as fluid pressure, temperature, and material composition. The measurement components may be further configured to measure pressure transients, and other flow rate metrics and properties such as flow rate, viscosity, and/or density. The test cycle may further include a fluid injection PTA phase that follows the inflow test phase.

Example Illustrations

FIG. 1 is a block diagram depicting a formation test system 100 configured and implemented within a well system in accordance with some embodiments. Formation test system 100 includes subsystems, devices, and components configured to implement a testing procedure within a wellbore 107 that in the depicted embodiment is an uncased, open borehole that is formed within a formation 109. Formation test system 100 includes wellhead 102 that includes components for configuring and controlling deployment in terms of insertion and withdrawal of a test string 104 within wellbore 107. Test string 104 may comprise multiple connected drill pipes, coiled tubing, or other downhole fluid conduit that is extended and retracted using compatible drill string conveyance components 111 within wellhead 102.

Test string 104 is utilized as the conveyance means for a test tool 110 that is attached via a connector section 112 to the distal end of test string 104. For example, test tool 110 may be attached such as by a threaded coupling to connector section 112, which may similarly be attached by threaded coupling to the end of test string 104. In addition to providing the means for extending and withdrawing test tool 110 within wellbore 107, test string 104 and connector section 112 form or include internal fluid conduits through which fluids may be withdrawn from or provided to test tool 110.

Test tool 110 may include multiple sampling and measurement devices and associated control and communication electronics housed within a tool body 116. For embodiments in which test tool 110 is deployed in a drill string, tool body 116 may comprise a drill string test collar. Communication and power source couplings are provided to test tool 110 via a wireline cable 114 having one or more communication and power terminals within wellhead 102. In some embodiments, wireline 114 is connected to test tool 110 following positioning of test tool 110 within wellbore 107. For instance, connector section 112 may include a seating for a wet latch 113 that is inserted into test string 104 such as via a side entry portal 118. Wet latch 113 may comprise an elastomeric dart that is attached to an end connector (not depicted) of wireline 114. To make connection between wireline 114 and test tool 110, wet latch 113 is pumped downward through test string 104 using a fluid medium such as drilling mud until wet latch 113 seats within connector section 112 resulting in the end connector of wireline 114 electrically connecting to test tool 110.

Test tool 110 comprises components, including components not expressly depicted in FIG. 1, configured to implement formation testing including pressure transient analysis (PTA) testing. Test tool 110 comprises tool body 116 containing flow devices 120 that regulate inflow and outflow of formation and other fluids into and out of test tool 110. For example, flow devices 120 may comprise a combination of one or more pumps, valves, nozzles and other flow devices interconnected by fluid conduits. Flow devices 120 are configured to provide flow pathways and flow inducement pressures for withdrawing formation fluids and injecting drill-in and injection fluids from and into test tool 110. In some embodiments, flow devices 120 withdraw fluid from and inject fluid into formation 109 via a probe 115 having a probe body 117 that is controllably extended from tool body 116 to seat on an inner borehole surface 108 of wellbore 107. Flow devices 120 may be further configured to withdraw and inject fluid from and into the annular wellbore region via a set of one or more flow ports 124 configured as orifices disposed at the body surface of test tool 110.

Test tool 110 further includes measurement instruments 128 for measuring, detecting, or otherwise determining material and flow properties for wellbore and formation fluids. For example, measurement instruments 128 may include a pressure detector for detecting fluid pressure within fluid conduits within test tool 110 and/or within the annular borehole region. Pressure detection components may include a pressure recorder for recording a pressure transient comprising pressure values measured over a time period such as a pressure rise or build up period following an intake flow and/or a pressure drop or fall off period following an injection flow. Measurement instruments 128 may further include a flow rate detector for measuring and recording flow rates of fluids withdrawn by and/or expelled from test tool 110 or injected from test tool 110 into formation 109.

Measurement instruments 128 may further include fluid properties detectors for measuring composition, fluid viscosity and compressibility and/or environment properties such as temperature and pressure. Test tool 110 may further include a sample chamber 126 for collecting fluid samples to be locally tested by in situ measurement instruments 128 and/or to be stored for later measurement analysis by a surface fluid testing system. Fluid property sensors within measurement instruments 128 may be used to determine the material characteristics of the samples.

Test tool 110 is configured to communicate the measured fluid property values as well as inflow and injection test operation information to a data processing system (DPS) 140. Test tool 110 may directly communicate measurement and other information via a communication interface 134 that is incorporated within or otherwise communicatively coupled to DPS 140 via wireline 114 and/or via an alternate transmission link. Test tool 110 may communicate to DPS 140 via a telemetry link 136 if, for example, wireline 114 is not included in the system or does not include a sufficient communication channel. Telemetry link 136 includes transmission media and endpoint interface components configured to employ one or more of a variety of communication modes. The communication modes may comprise different signal and modulation types carried using one or more different transmission media such as acoustic, electromagnetic, and optical fiber media. For example, pressure pulses may be sent from the surface using the fluid in the drill pipe as the physical communication channel and those pulses received and interpreted by test tool 110. Communication interface 134 is configured to transmit and receive signals to and from test tool 110 as well as other devices within formation test system 100 using a communication channels within wireline 114 and/or telemetry link 136.

DPS 140 may be implemented in any of one or more of a variety of standalone or networked computer processing environments. As shown, DPS 140 may operate above a terrain surface 103 within or proximate to wellhead 102, for example. DPS 140 includes processing and storage components configured to receive and process formation test and measurement information to generate flow control signals. DPS 140 is configured to process formation test data received from test tool 110, such as pressure transient data, to determine permeability, physical extent, and hydrocarbon capacity of formation 109. DPS 140 includes, in part, a computer processor 142 and a memory device 144 configured to execute program instructions for generating the flow control signals and the formation properties information.

DPS 140 is configured to control operating parameters of various flow control components such as surface and downhole pumps and valves. DPS 140 includes program components configured to coordinate inflow and outflow flow to and from formation 109 at various test locations within wellbore 107. Loaded and executing within memory 144, a flow controller application 146 is configured to implement inflow fluid testing in coordination with outflow/injection flow testing. Flow controller 146 is configured using any combination of program instructions and data to process flow configuration data in conjunction with flow test parameters to generate the flow control signals. The flow configuration data may include pump flow capacities and overall fluid throughput capacities of the surface and sub-surface flow control networks.

Flow controller 146 is further configured to receive input instructions and data from a test controller 150. Test controller 150 is configured to generate test instructions in response to or otherwise based on test input instructions such as may be received via an input/output device and/or signals received from test tool 110. Test controller 150 may generate messages and signals instructing flow controller 146 to implement a formation test cycle comprising a probe deployment and drill-in phase (DI phase) followed by a test phase. Flow controller 146 includes a drill-in flow adapter 148 configured to implement flow control operations during the DI phase, and a test flow adapter 149 configured to implement flow control operations during the test phase. The flow control instructions generated by flow adapters 148 and 149 during drill-in and test phases may vary based on input received from downhole test and measurement instruments. Drill-in flow adapter 148 is configured to generate instructions/signals based, at least in part, on pressure measurement and other data received from test tool 110. Test flow adapter 149 is configured to generate instructions/signals based, at least in part, on fluid and formation properties measurement information generated and collected by test tool 110 such as during fluid inflow testing.

The components of flow controller 146, including adapters 148 and 149, are configured, using a combination of program instructions and calls to activate and modulate operation of flow control devices including a pair of pumps 168 and 170. Each of pumps 168 and 170 comprises a fluid transfer pump such as a positive-displacement pump. Each of pumps 168 and 170 is configured to drive fluid from a respective fluid source into and through test string 104 via porting components 160 within wellhead 102. In the depicted embodiment, pump 168 is configured to pump drill-in fluid from a DI fluid source 156 and/or a test fluid from a test fluid source 157 during a formation test cycle. Pump 170 is configured to pump drilling fluid 158, sometimes referred to as drilling mud, in support of drilling and formation testing operations. Wellhead 102 further includes a recirculation line 174 driven by a recirculation pump 176 that recirculates the drilling fluid from wellbore 107 into drilling fluid source 158 such as when operating in drill mode and during downhole testing and sampling.

Pump 168 is configured to receive fluid from one or fluid sources such as DI fluid source 156 and test fluid source 157. DI fluid source 156 contains or otherwise supplies a drill-in fluid that may or may not have a different composition than the composition of fluid from test fluid source 157. The fluid supplied by DI fluid source 156 may comprise fluid components having a viscosity and/or other material properties that affect fluid flow. For example, DI fluid source 156 and/or test fluid source 157 may contain fluid components including one or more of diesel, drilling base fluid, and/or treated water such as treated seawater. Pump 170 is configured to receive fluid from a drilling fluid source 158, which may supply oil-based drilling mud. Pumps 168 and 170 are configured to drive fluid from a respective one or more sources into the fluid conduit formed by test string 104 via the porting components 160. One or more pumps may be configured in parallel or series with drilling fluid pump 170 to achieve injection characteristics such as but not limited to injection pressure, flowrate and flowrate control. A throttling system may be used downhole within test tool 110, in the connector section 112, and/or within DPS 140 to control flow rate.

Each of pumps 168 and 170 may include a control interface such as a locally installed activation and switching microcontroller that receives activation and switching instructions from DPS 140 via a telemetry link 152. For instance, the activation instructions may comprise instructions to activate or deactivate the pump and/or to activate or deactivate pressurized operation by which the pump applies pressure to drive the fluid received from a response of the fluid sources into and through test string 104. Switching instructions may comprise instructions to switch to, from, and/or between different fluid pumping modes. For instance, a switching instruction may instruct the target pump 168 and/or 170 to switch from low flow rate (low pressure) operation to higher flow rate (higher pressure) operation.

By issuing coordinated activation and switching instructions to pumps 168 and 170, DPS 140 controls and coordinates flow pressures and/or flow rates of fluids from each of fluid sources 156, 157, and 158 through test string 104. Additional flow control, including individual control of flow from the fluid sources 156, 157, and 158 to pumps 168 and 170 is provided by electronically actuated valves 164 and 166. Each of valves 164 and 166 has a control interface such as a microcontroller that receives valve position instructions from DPS 140 via telemetry link 152. For instance, the valve position instructions may comprise instructions to open, close, or otherwise modify the flow control position of the valve. DPS 140 issues instructions to downhole flow devices 120 as well as to the flow devices within wellhead 102 to modulate pressure and/or flow rate. The flow control may include fluid outflow through drill string 104 and from probe 115 into formation 109. The flow control may also include fluid inflow into probe 115 from formation 109 and through at least a portion of the flow conduits within flow devices 120 and drill string 104.

The components of formation test system 100 are configured to implement inflow and outflow testing from which formation properties are determined. Such properties may include but not limited to formation mobility, permeability, porosity, rock-fluid compressibility, skin factor, anisotropy, reservoir geometry, and reservoir extent. Formation 109 typically includes physical discontinuities such as internal material discontinuities and faults that manifest as low permeability/flow barriers. Traditional DSTs entail fluid intake flow rate and pressure transient testing to locate formation edges and internal formation discontinuities. Conventional DST and conventional mini-DST operations impose significant equipment and operating costs as well as posing logistical, safety, and environmental issues. Mini-DSTs address some of these issues by using discrete probes to withdraw fluid from a wellbore surface.

The probes used for mini-DST operations are configured to seat on the outer surface of the wellbore and to inject and withdraw fluids through a surface layer that may be contaminated by drilling mud filtrates and other contaminants. The filtrate contamination may extend beyond the mud cake layer and into an invasion zone of the formation material. The contamination may affect the purity of initially withdrawn formation fluid, requiring withdrawal of significantly greater volumes of formation fluid and/or implementation of an initial wellbore surface cleaning operation. Filtrate contamination may also impede formation fluid pressure and permeability testing by altering the fluid permeability proximate the intake port of a mini-DST probe.

Formation test system 100 addresses issues posed by large scale and mini-DST systems by incoporating and utilizing a self-drilling probe assembly that reduces contamination and wellbore hydrostatic pressure interference. The probe assembly includes a test probe and supporting components configured to establish a relatively unobstructed fluid flow path between formation materials and the probe. The probe assembly is configured to extend a drill-in tubing from a test probe into and through wellbore material layers (e.g., mud cake layer, invasion zone) during a DI phase of a formation test cycle. The probe assembly further includes exciter components for inducing a vibration into the drill-in tubing to increase drill-in efficiency and effectiveness. In some embodiments, a flow control system includes components some of which may be included in or otherwise integrated with the probe assembly. The flow control system may be configured to induce flow within the drill-in tubing such as during the DI phase and/or during a test phase.

For formation test system 100, the probe assembly includes downhole components including probe 115 and an extension assembly 127. Probe 115 comprises a probe body 117 that during downhole deployment prior to and following a formation test cycle may be fully or partially housed within tool body 116. A probe actuator 119 is disposed within tool body 116 and is mutually configured with probe 115 to controllably extend probe body 117 outwardly toward a surface of wellbore 107 during probe deployment. Also during probe deployment, a brace member 121 may be outwardly extended to radially position and stabilize probe 115 within wellbore 107. While not expressly depicted in FIG. 1, the probe assembly may further include a seal pad disposed on the outer face of probe body 117 and that seats on the inner surface 108 of wellbore 107.

Following deployment and seating of probe 115, a dual phase formation test cycle is executed. The formation test cycle begins with a DI phase in which a drill-in (DI) tubing 125 is extended from within probe body 117 and into formation 109 to facilitate a subsequent test phase. During the DI phase, components within extension assembly 127 extend DI tubing 125 through a frontside port (not depicted) of probe body 117 and into formation 109. For example, extension assembly 127 may include a supply of DI tubing and actuation means such as a motorized mandrel activated by a local drill-in controller. The front tip of DI tubing 125 is extended at a programmed or otherwise controlled speed into surface layers of wellbore surface 108 that may include a mud cake layer.

Formation test system 100 includes surface and downhole components configured to facilitate penetration of the mud cake layer and, in some embodiments, an invasion zone by DI tubing 125 during the DI phase. Probe 115 includes an exciter 129 disposed within probe body 117 and in contact with DI tubing 125. As described and depicted in further detail with reference to FIGS. 2 and 3, exciter 129 is configured to induce a vibration in DI tubing 125 during the DI phase. In some embodiments, exciter 129 induces a resonant ultrasonic vibration that is transferred to the tip of DI tubing 125, facilitating penetration of tip into and through the mud cake layer and at least a portion of the invasion zone. In alternate embodiments, exciter 129 is configured to induce a non-resonant vibration such as an intermittent, non-periodic, or otherwise dissonant vibration at one or more vibration frequencies.

Also during the DI phase, an acoustic sensor 133 within formation test tool 110 may be utilized to measure or otherwise detect acoustic signals such induced within formation 109 by the resonant vibration of DI tubing 125. In some embodiments, acoustic sensor 133 comprises a piezoelectric transducer type sensor configured to detect and convert acoustic signals into electronic signals. In addition or alternatively, formation test system 100 may include a distributed acoustic sensor (DAS) 135 such as may be integrated within wellhead 102 and that includes an optical fiber 137 for implementing fiber optic based acoustic detection. The acoustic detection data may be transmitted by formation test tool 110 to DPS 140 for processing such as to determine properties such as anisotropy characteristics of formation 109.

Formation test system 100 further includes components including flow controller 146 and flow devices 120 that facilitate drill-in penetration and implement formation fluid sampling and pressure testing. Flow devices 120 include pumps and valves and fluid conduits for transporting fluids to and from probe 115. Flow controller 146 includes DI adapter 148 configured to generate instructions that may be otherwise translated as signals to flow control components such as pumps and valves within flow devices 120. DI adapter 148 generates and transmits signals to surface devices such as pump 168 for modulating pressure of fluid pumped through drill string 104 and into flow devices 120. In some embodiments, components, such as pressure detectors within extension assembly 127 are configured to detect internal fluid pressure within fluid conduits. For instance, a pressure transducer may be installed within extension assembly or elsewhere along the flow line from surface to DI tubing 125. Detected pressure information may be transmitted to DPS 140 and processed such as by flow controller and/or test controller 150 to generate fluid pressure instructions based on the detected pressure values such that a specified pressure is maintained within DI tubing 125 during the DI phase.

Figure 2:
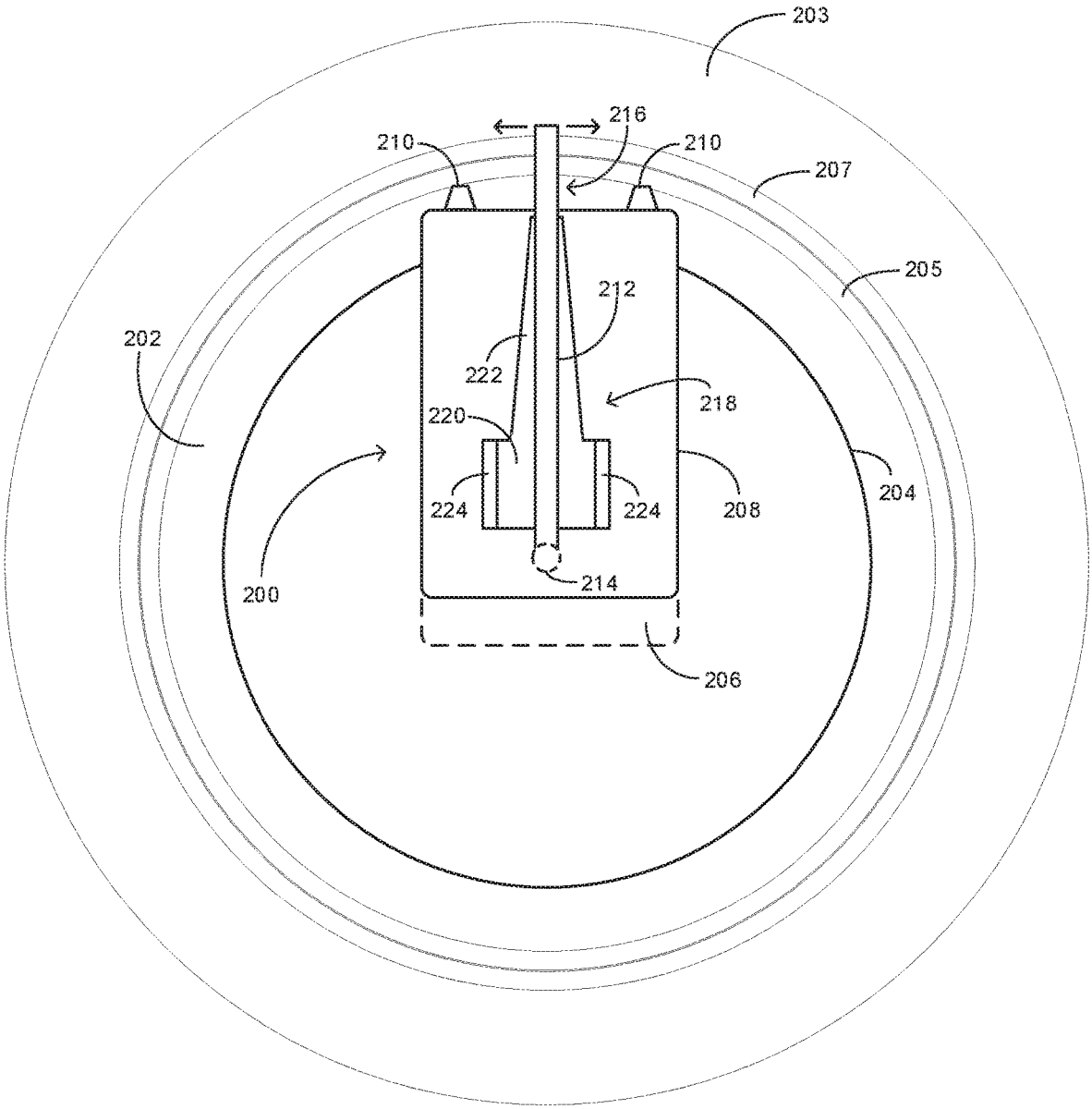
FIG. 2 is an overhead view illustrating deployment of a self-drilling test probe within a wellbore in accordance with some embodiments.
Figure 3:
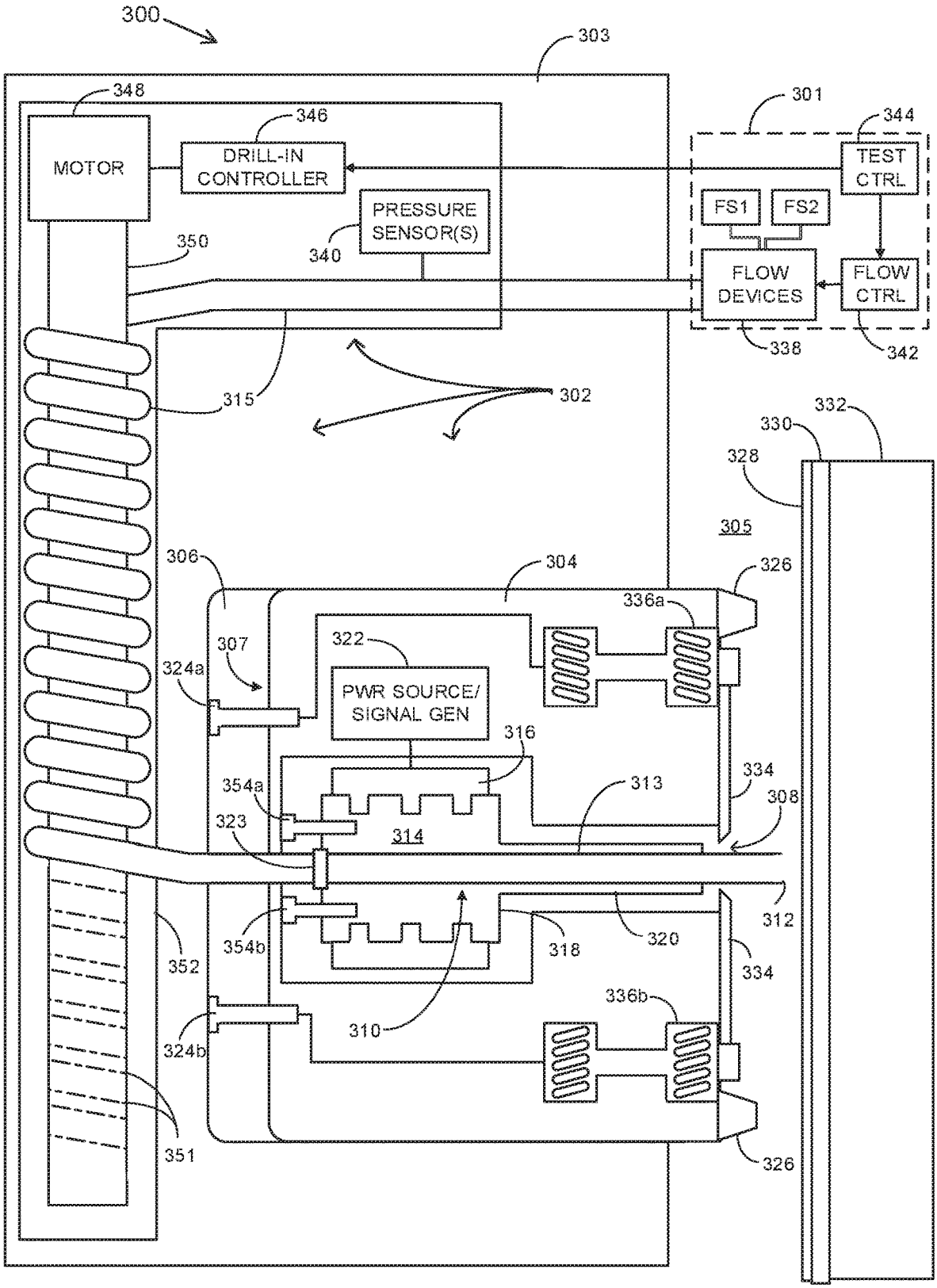
FIG. 3 is a partial cutaway profile view depicting a formation test tool deployed within a wellbore in accordance with some embodiments.

During latter stages of a DI phase, following establishment of a fluid conduit via insertion of DI tubing 125 into formation 109, other components within formation test system 100 may implement a formation test preparation phase to optimize fluid sampling and pressure testing. Such test preparation during the DI phase may involve testing the local permeability of the formation by measuring fluid pressure during fluid injection via DI tubing 125. The pressures measured during the DI phase may be used to optimize subsequent drilling operations at or proximate wellbore 107 to optimize acquisition of formation fluid samples during a fluid intake test phase or to facilitate fluid injection testing. The DI phase may conclude with the establishment of a substantially unobstructed and pressure isolated fluid conduit formed by DI tubing 125 between test tool 110 and formation 109. As depicted and described in further detail with reference to FIGS. 2 and 3, isolation for the fluid conduit between test tool 110 and formation 109 may be further enhanced such as by an on-probe seal pad and/or two or more isolation packers. In some embodiments, a seal pad may be formed around a front port through which the front tip of DI tubing 125 protrudes during a formation test cycle.

Following the DI phase, the test phase of a formation test cycle begins with test tool 110 actuating one or more of flow devices 120 such as a fluid intake valve. The valve actuation alone or in conjunction with negative pump pressure imparts negative pressure within the fluid conduit formed in part by flow tubing 125 that induces flow of formation fluid into test tool 110. During and following fluid intake, test tool 110 performs fluid and formation properties testing. Measurement instruments 128 may perform fluid content analysis to determine properties such as composition, viscosity, compressibility, bubble point, and gas-to-oil ratio.

In some embodiments, test tool 110 determines fluid properties such as temperature and pressure by directly measuring using measurement instruments 128. Measured pressures are used to determine a pressure transient over a period during and/or following the termination of the withdrawal of fluid from formation 109. The pressure transient may be processed by components within test tool 110 and/or DPS 140 to determine near wellbore properties such as formation mobility or permeability. The pressure transient information may be transmitted to DPS 140, which includes components such as formation model tool 151 that are configured to determine formation permeability based on the pressure transient information.

In addition to regulating test phase injection fluid composition, components within wellhead 102, DPS 140, and/or test tool 110 are configured to determine the flow rates and flow pressures applied during the test phase. For instance, flow controller 146 and test flow adapter 149 may be configured to determine and implement an injection procedure that applies a flow rate and/or flow pressure that may be modified from a default flow rate/pressure based on formation permeability and other formation and fluid properties measured or otherwise determined based on pressure measurements during the DI phase. Flow controller 146 may apply other parameters to limit or otherwise determine flow rates and pressures. For example, flow controller 146 in conjunction with components in wellhead 102 and test tool 110 may set and maintain the injection flow rate and/or flow pressure below the fracture pressure of formation 109.

Flow controller 146 is configured to begin an injection procedure following a fluid intake phase or otherwise when the formation fluid pressure within drill-in tubing 125 returns to steady-state formation reservoir pressure. The steady-state pressure condition may be determined by test tool 110, which may transmit a corresponding signal to DPS 140. To implement and regulate the pressurized application of the injection fluid, flow control instructions generated by flow controller 146 are transmitted to corresponding flow control components. In response to the instructions, the flow control components, such as pump 168 and valve 164 drive instruction-specified quantities of fluids from fluids source 157 into test string 104 at instruction-specified intervals corresponding to specified injection volumes. The fluids are transported via test string 104 into and through flow conduits and outlet ports within test tool 110.

Following stoppage of fluid injection, a pressure transient within the contained fluid conduit formed in part by DI tubing 125 in the form of a pressure fall is detected and recorded by measurement instruments 128. Specifically, pressure within the fluid conduit decreases toward reservoir pressure as the injection fluid dissipates within formation 109. The pressure drop information is transmitted by test tool 110 to DPS 140 and processed by formation modeling tool 151 to determine formation properties such as formation permeability and flow discontinuities. Formation model tool 151 processes the pressure drop transient detected subsequent to injection similar to the processing of pressure rise information for the intake test.

FIG. 2 is an overhead view illustrating deployment of a self-drilling probe 200 deployed within a wellbore 202 in accordance with some embodiments. Wellbore 202 is formed by drilling into a formation 203 comprising a volume of rock that may contain hydrocarbon material. The cylindrical inner surface wall of wellbore 202 is formed at least in part by a mud cake layer 205. Mud cake layer 205 is typically formed by the solid components of drilling mud and drilling cuttings as the liquid portion of the drilling mud leaks into formation 203. The fluid components and fine particles within the drilling mud may travel past mud cake layer 205 into the formation material to form an invasion layer 207 behind mud cake layer 205. The material composition and structure of mud cake layer 205 may have a substantially lower permeability than formation 203 and therefore may impose a permeability barrier that interferes with fluid flow. Similarly, but possibly to a lesser extent, the drilling mud components deposited within invasion layer 207 may form a permeability barrier or discontinuity that may distort or otherwise affect fluid flow from formation 203 into wellbore 202.

Similar to probe 115, probe 200 includes a probe body 208 composed of one or more materials configured to house and otherwise internally support probe components. Probe body 208 is disposed within a probe chamber 206 of a tool body 204. Tool body 204 may comprise a metallic alloy or other relatively hard and rigid material having a generally cylindrical contour for optimal conformance and mobility within the substantially cylindrical wellbore 202. For embodiments in which probe 200 is deployed in a drill string, tool body 204 may be configured as a casing component. If probe 200 is deployed as part of a wireline test string, tool body 204 may comprise a substantially cylindrical test tool body.

The probe components include a DI tubing 212 disposed along a channel formed within probe body 208. A fluid connection 214 couples the portion of DI tubing within probe body 208 to an external fluid source, such as a drill-in fluid source and/or a test fluid source. Probe components further include an exciter component comprising a vibration source 224 and an acoustic horn 218. Vibration source 224 may be configured using a combination of electrical, mechanical, and/or electromechanical components to generate a substantially continuous, resonant vibration. In some embodiments, vibration source 224 may comprise a piezoelectric transducer and a signal generator that applies a signal input to the transducer. In response to the signal input, the piezoelectric transducer generates an acoustic (e.g., ultrasonic) vibration. In alternate embodiments, vibration source 224 may include components constructed using magnetorestrictive materials react with material deformation and motion to generate vibrations that may range from sub-sonic to ultrasonic. In other embodiments, vibration source 224 may include electromagnetic voice coil components that similarly generate acoustic vibration in response to electromagnetic excitation signals. In some embodiments, vibration source 224 may include fluidic vibration components configured to mechanically induce and drive vibrations into DI tubing 212 via acoustic horn 218.

Acoustic horn 218 comprises a substantially solid and rigid body forming at least a portion of the inner channel in which DI tubing 212 is disposed in contact with an inner cylindrical surface of acoustic horn 218. The body of acoustic horn 218 includes a portion referred to herein as a base 220 and a portion referred to herein as a muzzle 222. Base portion 220 is positioned and contoured to contact vibration source 224 such that the acoustic vibration is transferred from vibration source 224 to the base 220 and muzzle 222 portions of acoustic horn 218 via contact interfaces between vibration source 224 source and base 220. As shown, muzzle portion 222 is narrower than base portion 220 and tapers lengthwise from wider proximate the base portion 220 and narrower proximate the front side of probe body 208.

During probe deployment, probe body 208 is extended outwardly from probe chamber 206 toward a wall face surface area of mud cake layer 205. Probe 200 includes a seal pad 210 on its outwardly facing frontside surface that contacts and seats on the surface of mud cake layer 205 upon probe deployment. The seated seal pad 210 forms a substantially impermeable seal that provides hydraulic pressure and material isolation for the wellbore volume between probe 200 and mud cake layer 205.

Following seating deployment of probe 200, a formation test cycle may be executed. The formation cycle begins with a DI phase in which DI tubing 212 is driven or otherwise extended through the channel passing through probe body 208 in part via an internal channel within acoustic horn 218. An electrical and/or electromechanical mechanism such as an internal piston (not expressly depicted in FIG. 2) may be used to extend DI tubing 212 by linearly displacing acoustic horn 218 that mechanically contacts DI tubing 212. In addition or alternatively, a motorized actuator may be utilized to drive DI tubing 212 such as from a source spindle/mandrel (not expressly depicted in FIG. 2). During tubing extension, vibration source 224 is activated to induce a resonant vibration into DI tubing 212 via acoustic horn 218. Extension of DI tubing 212 during the DI phase results in a frontside tip 216 of DI tubing 212 protruding from a frontside port and extending into and through mud cake layer 205. The extension and contemporaneous vibration results in a more effective drilling/boring actuation of DI tubing 212 in which the vibratory motion erodes, wears, or otherwise abrades materials within wellbore surface layers such as mud cake layer 205, invasion layer 207, and a near-surface layer of formation 203. Also during the DI phase, a DI fluid may be pumped, gravity driven, or otherwise pressurized within DI tubing 212. The DI fluid pressurization may enhance drilling/boring by producing an outflow from the open end of frontside tip 216 that clears debris during drill-in and may lubricate the surface of frontside tip 216.

FIG. 3 is a partial cutaway profile view depicting a formation test system 300 deployed within a wellbore 305 in accordance with some embodiments. Test system 300 includes a surface control assembly 301 having components that are communicatively and mechanically coupled with components of a probe assembly 302 within a tool body 303. Depending on implementation (drill string or wireline), tool body 303 may comprise a tool collar or a wireline tool body. Probe assembly 302 includes a probe 307 having a probe body 304 disposed within a probe chamber 306 that is formed within tool body 303. Probe assembly 302 further includes a motorized mandrel comprising a motor 348 that rotatably controls a tubing mandrel 350.

As shown, tool body 303 has been positioned such that probe 307 is positioned downhole and outwardly facing a portion of surface area of wellbore 305. The representative cross-section depiction of the surface and underlying materials forming wellbore 305 include a mud cake layer 328 forming the outer surface of wellbore 305. Behind the mud cake layer 328 is an invasion layer 330 behind which is the non-invaded formation 332 (i.e., formation that is substantially non-contaminated by non-native materials such as drilling fluid components and drill cuttings).

Probe 307 includes a DI tubing 310 that is at least partially disposed within a channel running through probe body 304 to an open frontside port 308. As utilized herein, drill-in tubing may refer to a frontend segment of or all of an overall tubing assembly. In the depicted embodiment, DI tubing 310 may comprise a frontend segment 313 that is coupled to backend tubing 315 via a tubing coupler 323. In some embodiments, front end segment 313 may comprise a substantially rigid tubular member having a different and more rigid and less flexible material composition that the composition of the backend tubing 315. For example, front end segment 313 may comprise a substantially rigid tubular member composed of a metallic alloy or a ceramic composition. While some embodiments may utilize a materially distinct frontend segment as DI tubing 310, in other embodiments the DI tubing 310 comprises the entire length of tubing from the front tip to backend with or without an intermediary connector.

As shown, the backend 315 of the DI tubing is wound onto or otherwise supported by tubing mandrel 350, which may include a spiral groove pattern 351 within its surface to support the tubing in a stable manner. Motor 348 may be a stepper motor or other type of motorized actuator that controls rotation of tubing mandrel 350 to control extension and/or retraction of DI tubing 310 such as during or following a DI phase. Motor 348 may control rotation of the tubing mandrel and consequent extension of DI tubing 310 based, at least in part, on input signals and instructions received from a DI controller 346.

During probe deployment, such as may be initiated by a test controller 344, probe body 304 is extended outwardly toward the surface of wellbore 305. For example, test controller 344 may transmit instructions to a downhole microcontroller (not expressly depicted) that controls a pair of extension pistons 324*a* and 324*b*. Extension pistons 324*a* and 324*b* are configured to extend and retract probe body 304 from and back into probe chamber 306 based on controller input. For probe deployment, extension pistons 324*a* and 324*b* drive probe body 304 outwardly until a seal pad 326 seats on the surface of the wellbore layers.

Following probe seating, test controller 344 transmits signals to DI controller 346 to begin a DI phase of a formation test cycle. In response to the DI phase signal from test controller 344, DI controller 346 generates and transmits DI control signals probe assembly components that control extension of DI tubing 310, inducing of resonant vibration into DI tubing 310, and application of fluid within DI tubing. For instance, DI controller 346 may generate and transmit instructions to motor 348 for rotating tubing mandrel 350 to enable extension of DI tubing 310 via unwinding of a portion of backend tubing 315. The front end 313 of DI tubing 310 is disposed in the channel formed within an acoustic horn 314 having a base portion 318 in contact with a vibration source 316 and a narrower muzzle portion 320. The unwinding of backend tubing 315 and consequent extension of the front end 313 of DI tubing 310 from frontside port 308 may coincide and/or be in part driven by linear displacement of acoustic horn 314 by a pair of extension pistons 354*a* and 354*b*.

A power source and signal generator provide input signals to vibration source 316 during the extension of DI tubing 310 that drives the front tip 312 into and through mud cake layer 328 and invasion layer 330. In some embodiments, vibration source 316 is a piezoelectric transducer that generates ultrasonic acoustic vibration in accordance with input excitation signals from signal generator 322. In some embodiments, vibration source 316 is a vibration motor that generates a resonant acoustic vibration in accordance with input from signal generator 322.

Regardless of the type of vibration source, the vibration frequency may be modulated based on drill-in operation parameters. For example, DI controller 346 may receive downhole sensor information indicating resistance to the drill-in operation such as speed at which DI tubing is extending following initial contact with mud cake layer 328. DI controller 346 may vary the input signal to vary the vibration frequency based on detecting increased and/or decreased resistance to extension of DI tubing 310. Drill-in parameters including efficiency and drill-in speed may also be improved by the structure of DI tubing 310.

Test system 300 also includes components for modulating a flow rate and/or pressure of fluid within DI tubing 310 during the DI phase. Test controller 344 is configured to generate and transmit signals to a flow controller 342 to implement a drill-in operating mode for a set of flow devices 338 that may include surface and/or downhole pumps, valves, nozzles, etc. Flow controller 342 receives downhole sensor signals including pressure measurement signals from one or more pressure sensors 340. Pressure sensors 340 are installed on one or more locations along the continuous fluid conduit from the front end 313 of DI tubing 310 to the backend tubing 315 connection to flow devices 338. Flow controller 342 is configured to modulate fluid pressure and/or flow rate within DI tubing during the DI phase based on the fluid pressure measurements.

Following a DI phase, test controller 344 generates and transmits signals to flow controller 342 and other components to begin a test phase of the formation test cycle. For example, a test phase may include performing a fluid sampling test in which a relatively small volume of fluid is withdrawn from formation 332 via DI tubing 310. The test phase may also or alternatively include a PTA test in which fluid from one or both of fluid sources FS1 and FS2 is pumped or otherwise driving downhole through flow devices 338 and into formation 332 via DI tubing 310. For this type of injection test, components within surface control assembly 301 are configured to record pressure values detected by pressure sensors 340 during an ensuing pressure transient in which the raised pressure drops to steady state formation fluid pressure.

The formation test cycle concludes for the test location following the test phase. Test controller 344 is configured to generate and transmit instructions to tubing control components such as motor 348 and extension pistons 354*a* and 354*b* to retract the front tip 312 of DI tubing back into probe body 304. The front tip 312 may have been moderately deformed or damaged during the DI phase with the cutting efficiency of front tip 312 consequently reduced. Test system 300 includes components configured to remove and replace front tip as part of the DI tubing retraction process. For instance, probe 307 may include a tube cutter tubing cutter comprises a spring-actuated cutter assembly including one or more blades 334 coupled to one or more spring-driven actuators 336*a* and 336*b*.

Tube cutter comprising a pair of blade actuators 336*a* and 336*b* housed within probe body 304 and that are mechanically linked with blades 334 that are disposed on the external frontside of probe body 304. The spring-driven actuators 336*a* and 336*b* are mechanically linked to a probe actuator such as extension pistons 324*a* and 324*b* and configured to open blades 334 in response to extension of probe body 304 and to close the blade in response to retraction of probe body 304. Blade actuators 336*a* and 336*b* including springs and other components configured to translate rotational motion of actuators 336*a* and 336*b* into linear displacement of the blades 334 to open and close blades 334.

Figure 4:
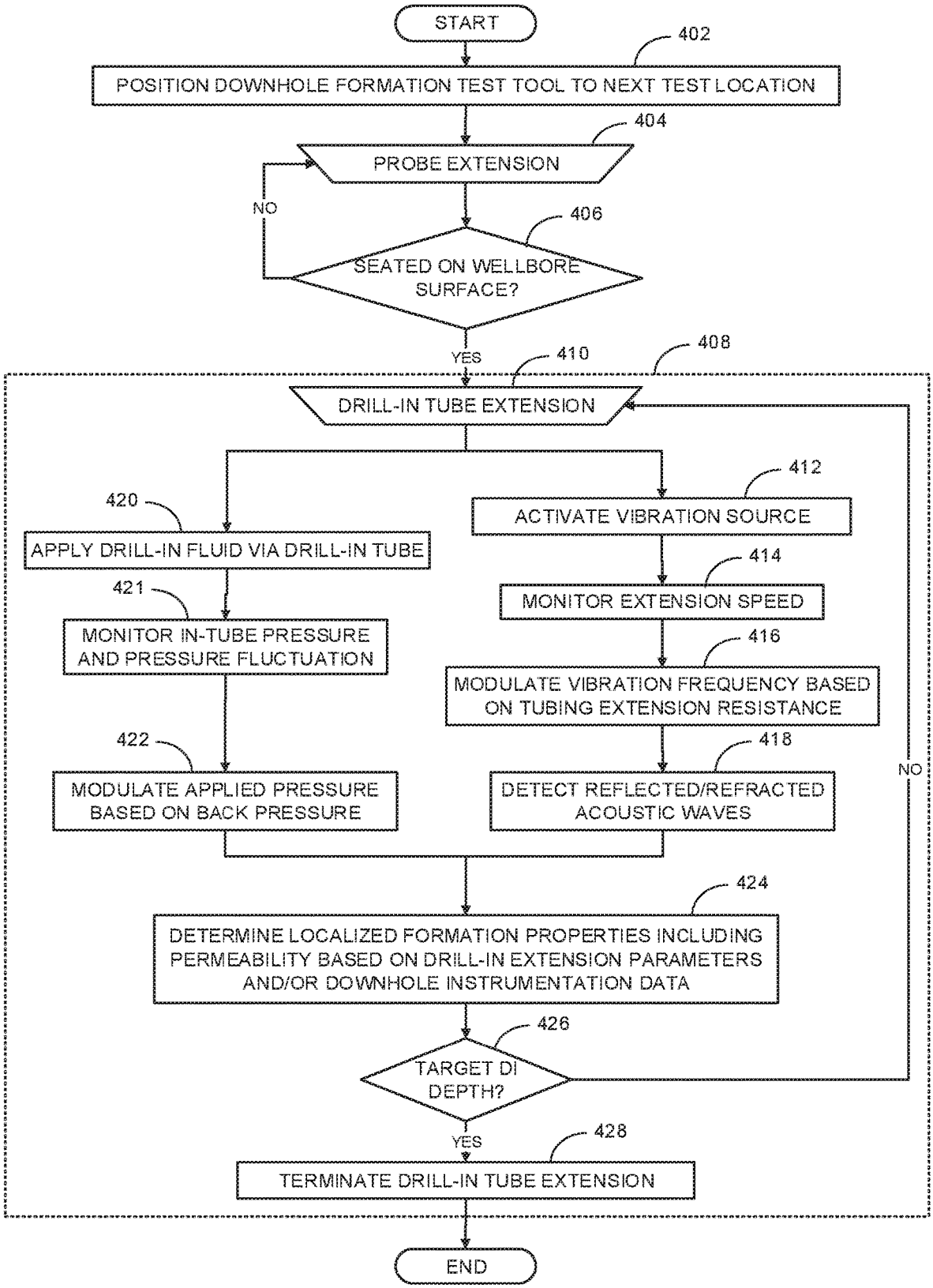
FIG. 4 is a flow diagram illustrating operations and functions performed during probe deployment and a drill-in phase of a formation test cycle in accordance with some embodiments.

FIG. 4 is a flow diagram illustrating operations and functions performed during probe deployment and a drill-in phase of a formation test cycle in accordance with some embodiments. The operations and functions depicted and described with reference to FIG. 4 may be implemented by the components, devices, and systems depicted and described with reference to FIGS. 1-3. The process begins as shown at block 402 with wellhead and downhole conveyance equipment positioning a formation test tool to a test location within a wellbore. The test tool includes a self-drilling probe that may be configured as depicted in FIGS. 1-3. Following positioning of the test tool, the formation test system deploys the probe by outwardly extending the probe until it is seated in contact with the surface wall of the wellbore that may include an outer mud cake layer (blocks 404 and 406).

Following seating of the probe, the formation test system implements a formation test cycle that includes a DI phase at superblock 408 during which DI tubing within the probe is drilled/bored into the wellbore surface. The DI phase begins with a DI controller instructing one or more actuator components to drive and extend the DI tubing through a channel within the probe and into a mud cake layer (block 410). Concurrent with the DI tubing extension at block 410, the test system induces a resonant vibration into a front end of the DI tubing to increase drill-in efficiency. At block 412, the DI controller activates a vibration source such as a piezoelectric transducer or a vibration motor. A vibration transfer component such as an acoustic horn transfers the vibration from the source to the front end of the DI tubing during extension.

As shown at block 414, the system may detect the speed of extension of the front tip of the DI tubing particularly after contacting the wellbore wall to determine a relative resistance to the drill-in operation. The DI controller may receive the extension speed information and may vary the excitation signal applied to the signal generator to modulate the vibration based on variations in extension speed or other indicators of drill-in resistance (block 416). The vibration of the DI tubing may induce acoustic signals within the formation, resulting in acoustic signals reflected, refracted or otherwise generated by formation materials. At block 418, an acoustic sensor within the test tool or otherwise disposed within the wellbore, such as a DAS, detects and records the reflected/refracted acoustic response from the formation.

The formation test system may further include flow control system comprising surface and downhole flow devices configured to induce and modulate fluid flow and fluid pressure during the DI phase. At block 420, flow devices within the wellhead and the test tool initiate fluid flow at a specified flow rate/pressure within the fluid conduit from the surface through the DI tubing and out from the open front tip of the DI tubing. In this manner, DI fluid is expelled from the front tip of the DI tubing while the front tip is driven into and through a mud cake layer and subsequent layers such as an invasion layer and into the formation. As the DI tubing is driven into the wellbore layers, pressure sensors monitor fluid pressure and fluctuations in pressure within the fluid conduit that includes the DI tubing (block 421). At block 422, the flow controller modulates the fluid pressure and/or flow rate within the fluid conduit based, at least in part, on the detected pressures and/or pressure fluctuations.

The test system may further include programmed components for determining formation properties based on information collected during the drill-in operation. As shown at block 424, for example, the system may include a formation modeling tool that receives pressure and pressure fluctuation information collected during drill-in to determine localized formation properties such as permeability and formation pressure. The operations and functions within superblock 408 continue until a drill-in target depth is reached (block 426) and the drill-in phase terminates at block 428.

Figure 5:
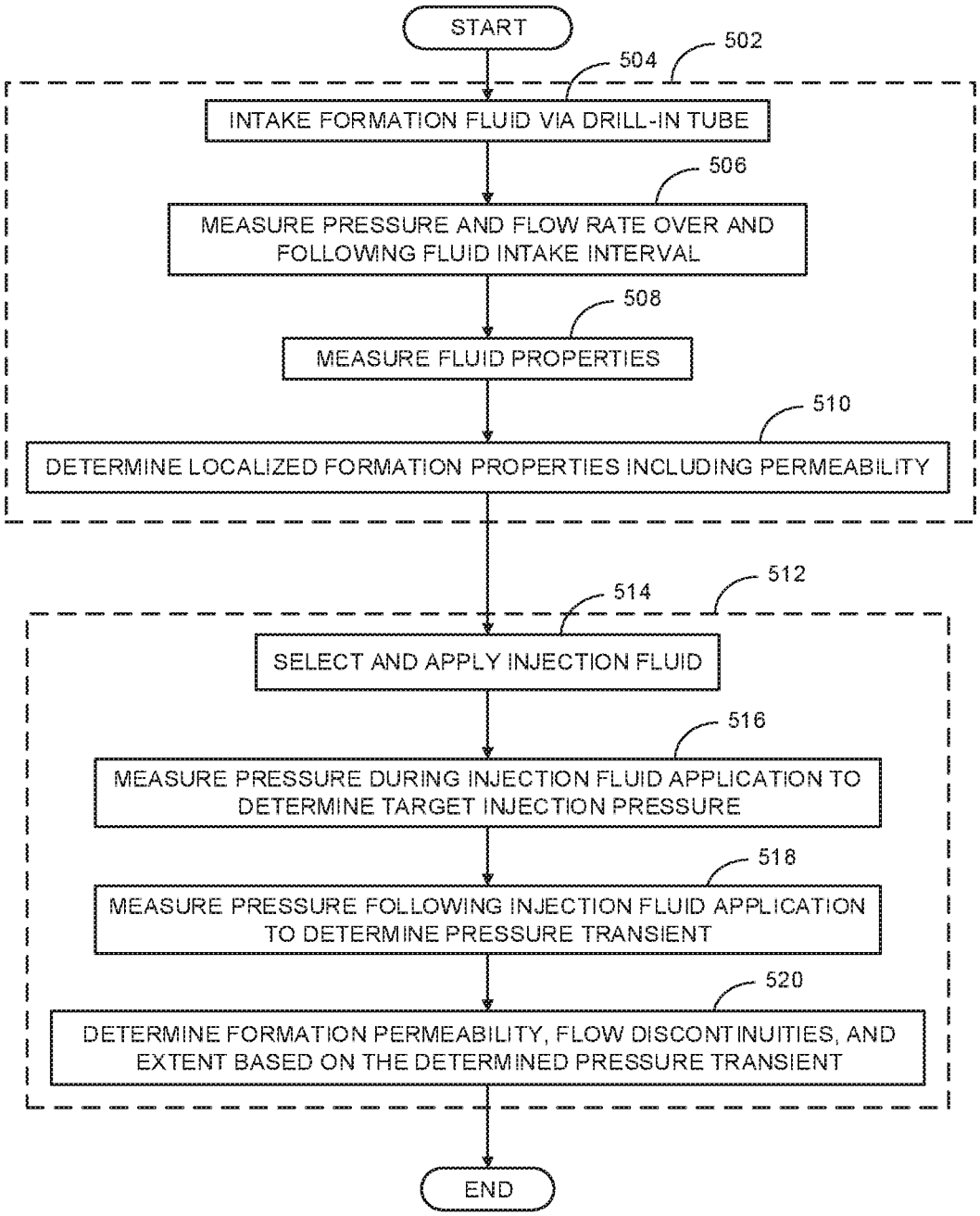
FIG. 5 is a flow diagram illustrating operations and function performed during a test phase of a formation test cycle in accordance with some embodiments.

FIG. 5 is a flow diagram illustrating operations and function performed during a test phase of a formation test cycle in accordance with some embodiments. The operations and functions depicted and described with reference to FIG. 5 may be implemented by the components, devices, and systems depicted and described with reference to FIGS. 1-3. The process begins following a DI phase in which a self-drilling probe housed within a test tool has been deployed and DI tubing within the probe has been drilled or otherwise inserted into material layers of a wellbore wall. In some embodiments, the process begins following insertion of the DI tubing through mud cake and invasion layers and to non-invaded formation material. The test phase may begin with operations performed during an inflow test sub-phase represented at superblock 502.

The inflow test sub-phase begins as shown at block 504 with a flow controller generating and transmitting instructions to flow devices to intake a limited volume of formation fluid via the DI tubing. At block 506, sensors and detectors within the test tool measure pressure and flow rate over the fluid intake interval. The fluid is collected and at block 508 sensors within the test tool measure fluid properties such as density and viscosity. The inflow test sub-phase concludes as shown at block 510 with a formation model tool receiving and processing the fluid properties information as well as the pressure and/or flow rate information to determined localized formation properties such as permeability and formation pressure.

The test phase continues with a PTA test sub-phase represented as superblock 512. As shown at block 514, the PTA test sub-phase begins with selection and application of an injection fluid to be injected through the DI tubing and into the formation at a specified pressure and/or flow rate. In some embodiments, the injection fluid may be selected to have specified viscosity, density, and other properties based on the determine local formation properties and formation fluid properties. The injection fluid is pumped or otherwise driven (e.g., gravity driven) into the formation over an injection interval. During the injection interval pressure sensors such as within the test tool measure pressure within the fluid conduit to determine when a specified pressure has been reached (block 516). The injection interval terminates in response to detecting the specified pressure and pressure sensors continue detecting pressure following injection to determine a pressure transient in terms of a reduction in pressure to a steady state formation pressure over a time interval (block 518). The PTA test sub-phase concludes at block 520 with a formation model tool receiving and processing the pressure and pressure transient information to determine formation properties such as formation permeability, pressure, and discontinuities.

Figure 6:
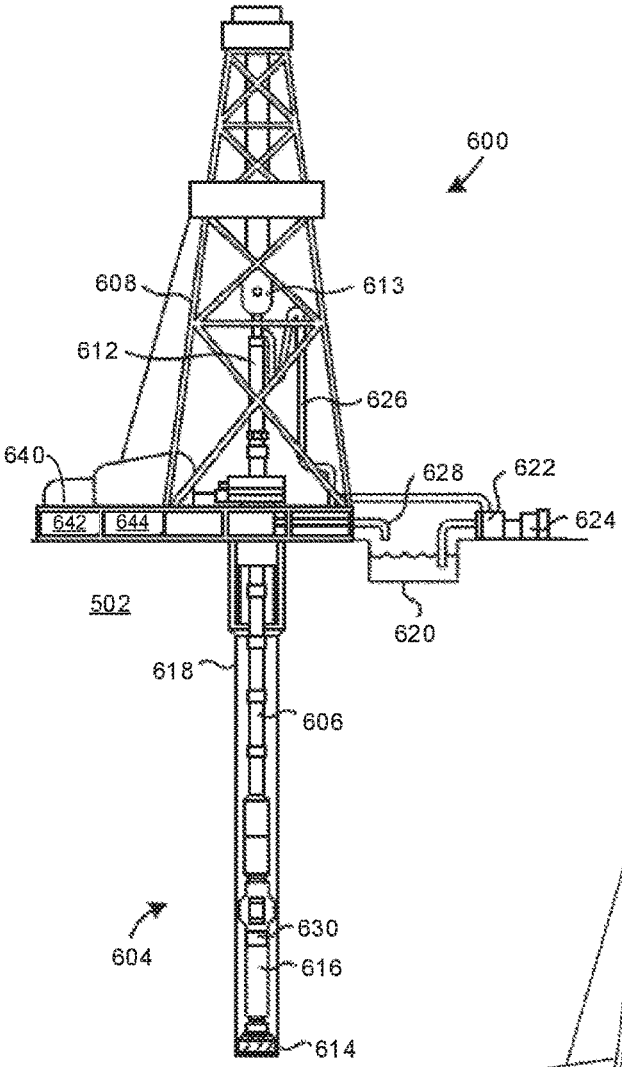
FIG. 6 illustrates a drilling system in accordance with some embodiments.

FIG. 6 illustrates a drilling system 600 in accordance with some embodiments. Drilling system 600 is configured to include and use test tool components for measuring formation properties such as formation permeability, porosity, pressure and discontinuities. The test tool components may also be used to determine formation fluid properties such as density, viscosity, and material composition. The resultant formation and fluid properties information may be utilized for various purposes such as for modifying a drilling parameter or configuration, such as penetration rate or drilling direction, in a measurement-while-drilling (MWD) and a logging-while-drilling (LWD) operation. Drilling system 600 may be configured to drive a bottom hole assembly (BHA) 604 positioned or otherwise arranged at the bottom of a drill string 606 extended into the earth 602 from a derrick 608 arranged at the surface 610. Derrick 608 may include a kelly 612 and a traveling block 613 used to lower and raise kelly 612 and drill string 606.

BHA 604 may include a drill bit 614 operatively coupled to a tool string 616 that may be moved axially within a drilled wellbore 618 as attached to the drill string 606. During operation, drill bit 614 penetrates the earth 602 and thereby creates wellbore 618. BHA 604 may provide directional control of drill bit 614 as it advances into the earth 602. Tool string 616 can be semi-permanently mounted with various measurement tools (not shown) such as, but not limited to, MWD and LWD tools, that may be configured to perform downhole measurements of downhole conditions. In some embodiments, the measurement tools may be self-contained within tool string 616, as shown in FIG. 6.

Drilling and injection fluid from a drilling fluid tank 620 may be pumped downhole using a pump 622 powered by an adjacent power source, such as a prime mover or motor 624. The drilling fluid may be pumped from the tank 620, through a stand pipe 626, which feeds the drilling fluid into drill string 606 and conveys the same to drill bit 614. The drilling fluid exits one or more nozzles arranged in drill bit 614 and in the process cools drill bit 614. After exiting drill bit 614, the drilling fluid circulates back to the surface 610 via the annulus defined between wellbore 618 and drill string 606, and in the process, returns drill cuttings and debris to the surface. The cuttings and mud mixture are passed through a flow line 628 and are processed such that a cleaned drilling fluid is returned down hole through stand pipe 626.

Tool string 616 may further include a downhole test tool 630 that includes a self-drilling probe similar to the downhole test tools described herein. More particularly, downhole tool 630 may have a self-drilling probe from which DI tubing is driven into wellbore wall material. During deployment within the wellbore 618, test tool 630 may be operated in accordance with the steps described with reference to FIGS. 1-5. Test tool 630 may be controlled from the surface 610 by a computer 640 having a memory 642 and a processor 644. Accordingly, memory 642 may store commands that, when executed by processor 644, cause computer 640 to perform at least some steps in methods consistent with the present disclosure.

Figure 7:
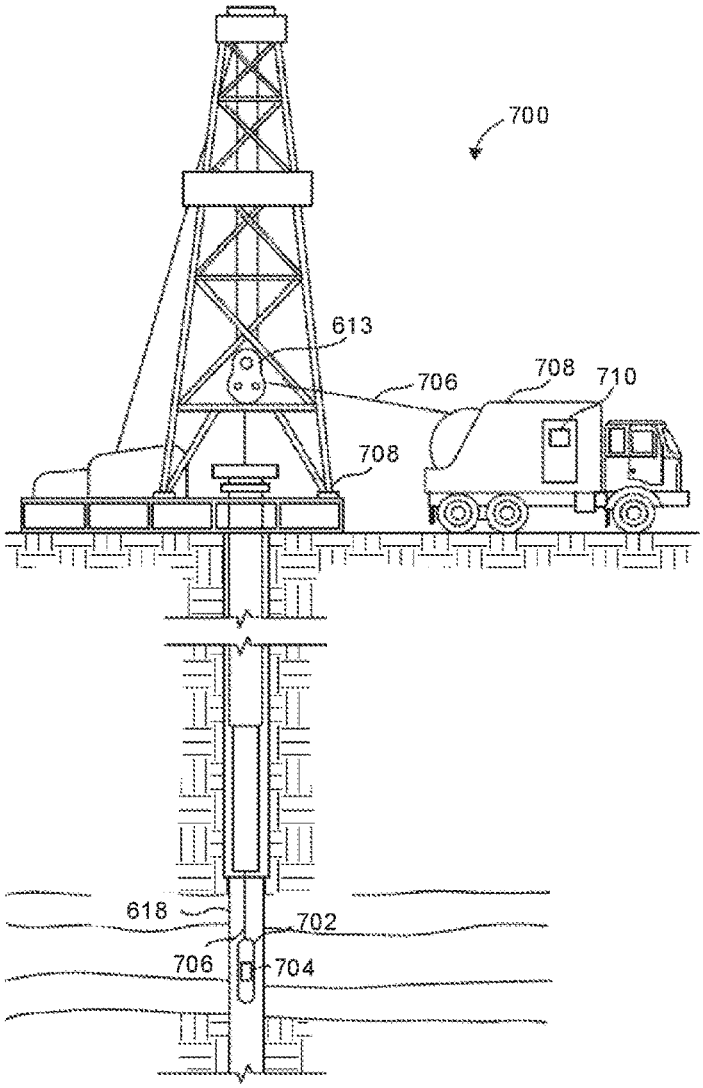
FIG. 7 depicts a wireline logging system in accordance with some embodiments.

FIG. 7 illustrates a wireline system 700 that may employ one or more principles of the present disclosure. In some embodiments, wireline system 700 is configured to use a formation test tool that includes a self-drilling probe. After drilling of wellbore 618 is complete, it may be desirable to determine details regarding composition of formation fluids and associated properties through wireline sampling. Wireline system 700 may include a test tool 702 that forms part of a wireline logging operation that can include one or more measurement components 704, as described herein, as part of a downhole measurement tool. Wireline system 700 may include the derrick 608 that supports the traveling block 613. Wireline logging tool 702, such as a probe or sonde, may be lowered by a wireline cable 706 into wellbore 618.

Downhole tool 702 may be lowered to potential production zone or other region of interest within wellbore 618 and used in conjunction with other components such as packers and pumps to perform well testing and sampling. During deployment within the wellbore 618, test tool 702 may be operated in accordance with the steps described with reference to FIGS. 1-5. A logging facility 708 may be provided with electronic equipment 710, including processors for various types of data and signal processing including perform at least some steps in methods consistent with the present disclosure.

Example Computer

Figure 8:
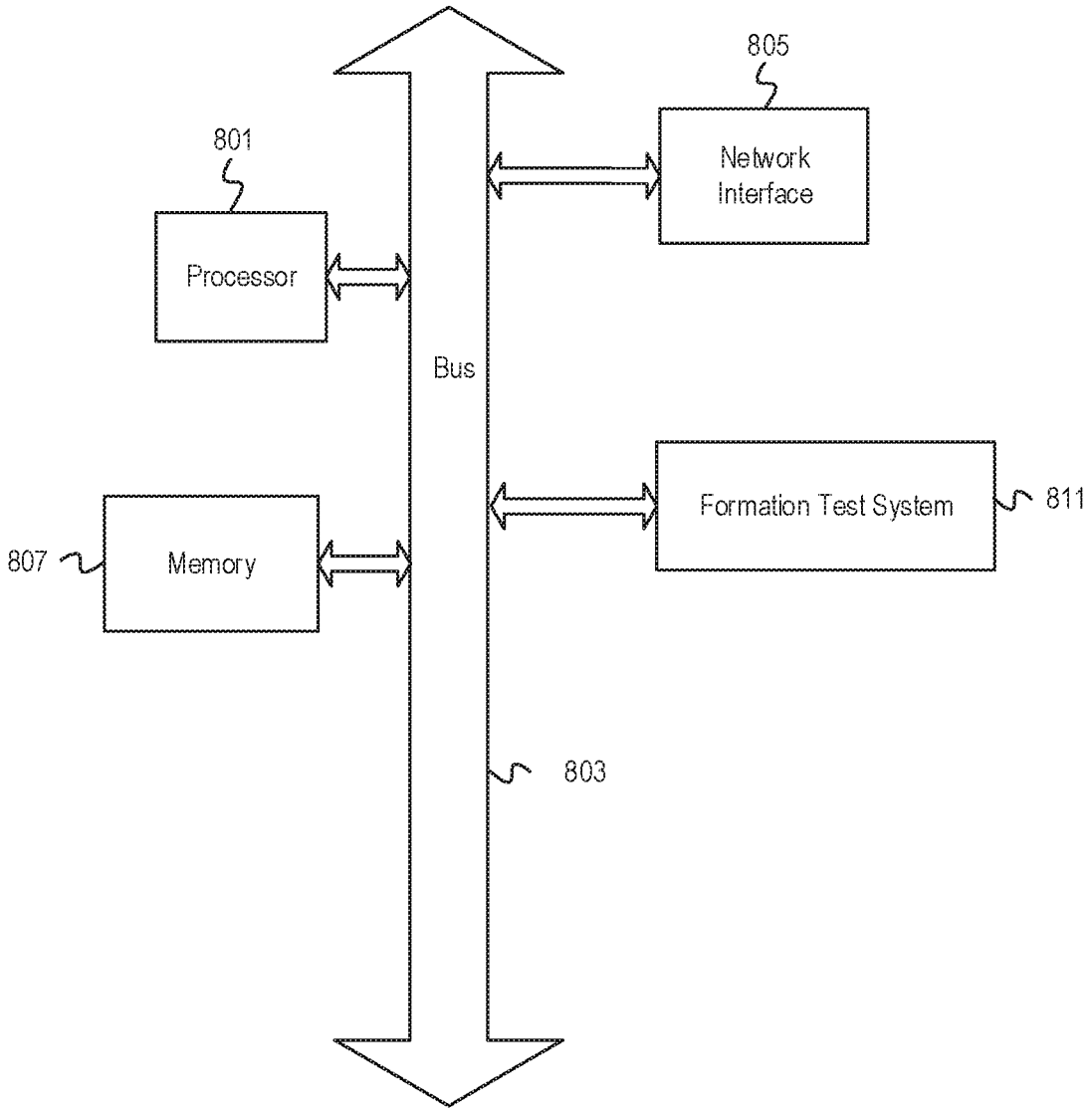
FIG. 8 illustrates a computer system configured to implement formation test operations in accordance with some embodiments.

FIG. 8 is a block diagram depicting an example computer system that may be utilized to implement drill-in and test phase operations for implementing a formation test cycle in accordance with some embodiments. The computer system includes a processor 801 possibly including multiple processors, multiple cores, multiple nodes, and/or implementing multi-threading, etc. The computer system includes a memory 807. The memory 807 may be system memory (e.g., one or more of cache, SRAM, DRAM, etc.) or any one or more of the above already described possible realizations of machine-readable media. The computer system also includes a bus 803 (e.g., PCI, ISA, PCI-Express, InfiniBand® bus, NuBus, etc.) and a network interface 805 which may comprise a Fiber Channel, Ethernet interface, SONET, or other interface.

The system also includes a formation test system 811, which may comprise hardware, software, firmware, or a combination thereof. Formation test system 811 may be configured similarly to DPS 140 that hosts tester controller 150, flow controller 146, and/or model tool 151 in FIG. 1. For example, formation test system 811 may comprise instructions executable by the processor 801. Any one of the previously described functionalities may be partially (or entirely) implemented in hardware and/or on the processor 801. For example, the functionality may be implemented with an application specific integrated circuit, in logic implemented in the processor 801, in a co-processor on a peripheral device or card, etc. Formation test system 811 generates fluid flow control signals based, at least in part, on injection test procedure information and downhole fluid properties information collected during a DI phase or an intake fluid testing portion of a test phase that follows a DI phase. The flow control signals may be transmitted to flow control devices such as pumps and valves in the manner described above.

Variations

While the aspects of the disclosure are described with reference to various implementations and exploitations, it will be understood that these aspects are illustrative and that the scope of the claims is not limited to them. In general, techniques for implementing formation testing as described herein may be performed with facilities consistent with any hardware system or systems. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. Use of the phrase "at least one of" preceding a list with the conjunction "and" should not be treated as an exclusive list and should not be construed as a list of categories with one item from each category, unless specifically stated otherwise.

EXAMPLE EMBODIMENTS

Embodiment 1: A formation test probe comprising a body having a channel therethrough to a frontside port; drill-in tubing, at least a portion of which is disposed within the channel, and having a front tip that is extensible from the frontside port; and an exciter disposed within the body in contact with the drill-in tubing and operably configured to induce vibration in the drill-in tubing. The formation test probe may further comprise a drill-in tubing actuator configured to drive the drill-in tubing through the channel such that the front tip is extended from the frontside port. The formation test probe may further include an acoustic horn forming a portion of the channel; and a vibration source coupled to said acoustic horn and configured to induce an acoustic vibration in said acoustic horn. The formation test probe may further comprise a base portion in contact with said vibration source; and a muzzle portion narrower than the base portion and extending from said base portion toward the frontside port. The muzzle may be configured to translate the acoustic vibration into an acoustic frequency linear vibration in the font tip of the drill-in tubing. The vibration source may comprise a piezoelectric transducer disposed within the body; and a signal generator coupled to said piezoelectric transducer. The formation test probe may further comprise a tubing cutter operably coupled to said body proximate the frontside port and configured to remove the front tip of the drill-in tubing. The formation test probe may further comprise a probe actuator that extends the body outwardly toward a wellbore surface, wherein said tubing cutter comprises a spring-actuated cutter assembly including a blade coupled to a spring-driven actuator, wherein the spring-driven actuator is mechanically linked to the probe actuator and is configured to open the blade in response to extension of the body and to close the blade in response to retraction of the body.

Embodiment 2: A formation test system comprising: a probe assembly disposed within a test tool and including, a body forming a channel therethrough to a frontside port; drill-in tubing disposed within the channel and having a front tip; a drill-in actuator configured to extend the front tip from the frontside port; and an exciter disposed within the body in contact with the drill-in tubing and configured to induce vibration in the drill-in tubing; and a flow control system configured to induce fluid flow within the drill-in tubing. The flow control system may comprise a pressure sensor configured to detect fluid pressure within the drill-in tubing; and a flow controller configured to modulate one or more flow parameters of flow devices based, at least in part, on the detected fluid pressure. The flow controller may be communicatively coupled to one or more flow devices and programmatically configured to modulate one or more flow parameters of the flow devices based, at least in part, on the detected fluid pressure. The flow controller may be configured to modulate fluid pressure or flow rate within the drill-in tubing during at least one of a drill-in phase and a test phase of a formation test cycle. The flow controller may be configured to modulate fluid pressure within the drill-in tubing based on detected fluid pressure within the drill-in tubing during a test phase of a formation test cycle. The exciter may include an acoustic horn forming a portion of the channel; and a vibration source coupled to the acoustic horn and configured to induce an acoustic vibration in the acoustic horn. The vibration source may comprise a piezoelectric transducer and a signal generator configured to induce ultrasonic vibration in said acoustic horn during a drill-in phase of a formation test cycle. The formation test system may further comprise a drill-in controller configured to control insertion of the drill-in tubing during a drill-in phase of a formation test cycle, including: extending the front tip of the drill-in tubing from the frontside port into a wellbore surface; and activating the vibration source to induce vibration in the drill-in tubing. The formation test system may further comprise a probe actuator configured to extend the body outwardly toward a wellbore surface to initiate the formation test cycle. The drill-in controller may comprise a programmable component that receives instructions from a test controller, said drill-in controller communicatively coupled to a drill-in tubing actuator that is configured to extend the drill-in tubing from the frontside port. Insertion of the drill-in tubing may include applying fluid pressure within the drill-in tubing from a fluid source.

Embodiment 3: A method for formation testing comprising: positioning a formation test tool to a test location within a wellbore; and deploying a probe proximate a wellbore surface at the test location, wherein the probe includes drill-in tubing having an extensible front tip, said deploying the probe including: extending the drill-in tubing from the probe into the wellbore surface; and inducing vibration in the drill-in tubing during said extending the drill-in tubing. The method may further comprise applying fluid pressure within the drill-in tubing during said extending the drill-in tubing. The method may further comprise detecting fluid pressure within the drill-in tubing; and wherein said applying fluid pressure within the drill-in tubing comprises modulating one or more flow parameters of fluid within the drill-in tubing based, at least in part, on the detected fluid pressure. The method may further comprise modulating a frequency of the induced vibration based, at least in part, on detected resistance to the extending of the drill-in tubing. The method may further comprise detecting reflected acoustic waves during said extending the drill-in tubing; and determining formation properties based, at least in part, on the detected acoustic waves. Extending the drill-in tubing into the wellbore surface may comprise extending the drill-in tubing through a mud cake layer and into formation material. The method may further comprise performing inflow testing including: withdrawing fluid from the formation into the drill-in tubing; and measuring at least one of pressure and flow rate during or following said withdrawing fluid. The method may further comprise performing injection testing including: injecting fluid from the drill-in tubing into the formation; and measuring pressure during or following said injecting fluid to determine a pressure transient.

What is claimed is:

1. A formation test probe comprising:

a body having a channel therethrough to a frontside port;

drill-in tubing, at least a portion of which is disposed within the channel, having a front tip that is extensible from the frontside port, wherein a backend of the drill-in tubing is wound onto a spiral groove and supported on a tubing mandrel, wherein the tubing mandrel includes the spiral groove in its surface; and an exciter disposed within the body in contact with the drill-in tubing and operably configured to induce vibration in the drill-in tubing.

2. The formation test probe of claim 1, further comprising a drill-in tubing actuator configured to drive the drill-in tubing through the channel such that the front tip is extended from the frontside port.

3. The formation test probe of claim 1, wherein said exciter includes:

an acoustic horn forming a portion of the channel; and a vibration source coupled to said acoustic horn and configured to induce an acoustic vibration in said acoustic horn.

4. The formation test probe of claim 3, wherein the vibration source comprises:

a piezoelectric transducer; and a signal generator coupled to said piezoelectric transducer.

5. The formation test probe of claim 3, wherein the acoustic horn comprises:

a base portion in contact with the vibration source; and a muzzle portion narrower than the base portion and extending from the base portion toward the frontside port;

wherein the muzzle portion is configured to translate the acoustic vibration into an acoustic frequency linear vibration in the front tip of the drill-in tubing.

6. The formation test probe of claim 1, further comprising a tubing cutter operably coupled to said body proximate the frontside port and configured to remove the front tip of the drill-in tubing.

7. The formation test probe of claim 6, further comprising a probe actuator that extends said body outwardly toward a wellbore surface, wherein said tubing cutter comprises a spring-actuated cutter assembly including a blade coupled to a spring-driven actuator, wherein the spring-driven actuator is mechanically linked to the probe actuator and is configured to open the blade in response to extension of the body and to close the blade in response to retraction of the body.

8. A formation test system comprising:

a probe assembly disposed within a test tool and including, a body forming a channel therethrough to a frontside port;

drill-in tubing disposed within the channel and having a front tip port, wherein a backend of the drill-in tubing is wound onto a spiral groove and supported on a tubing mandrel, wherein the tubing mandrel includes the spiral groove on its surface;

a drill-in tubing actuator configured to extend the front tip from the frontside port; and an exciter disposed within the body in contact with the drill-in tubing and configured to induce vibration in the drill-in tubing; and a flow control system configured to induce fluid flow within the drill-in tubing.

9. The formation test system of claim 8, wherein the flow control system comprises:

a pressure sensor configured to detect fluid pressure within the drill-in tubing; and a flow controller configured to modulate one or more flow parameters of flow devices based, at least in part, on the detected fluid pressure.

10. The formation test system of claim 9, wherein the flow controller is communicatively coupled to one or more flow devices and programmatically configured to modulate one or more flow parameters of the flow devices based, at least in part, on the detected fluid pressure.

11. The formation test system of claim 9, wherein the flow controller is configured to modulate fluid pressure or flow rate within the drill-in tubing during at least one of a drill-in phase and a test phase of a formation test cycle.

12. The formation test system of claim 11, wherein the flow controller is configured to modulate fluid pressure within the drill-in tubing based on detected fluid pressure within the drill-in tubing during the test phase of the formation test cycle.

13. The formation test system of claim 8, wherein said exciter includes:

an acoustic horn forming a portion of the channel; and a vibration source coupled to the acoustic horn and configured to induce an acoustic vibration in the acoustic horn, wherein said vibration source comprises a piezoelectric transducer and a signal generator configured to induce ultrasonic vibration in said acoustic horn during a drill-in phase of a formation test cycle.

14. The formation test system of claim 13, further comprising a drill-in controller configured to control insertion of the drill-in tubing during a drill-in phase of a formation test cycle, including:

extending the front tip of the drill-in tubing from the frontside port into a wellbore surface; and activating the vibration source to induce vibration in the drill-in tubing.

15. The formation test system of claim 14, further comprising a probe actuator configured to extend the body outwardly toward a wellbore surface to initiate the formation test cycle.

16. The formation test system of claim 14, wherein the drill-in controller is a programmable component that receives instructions from a test controller, said drill-in controller communicatively coupled to a drill-in tubing actuator that is configured to extend the drill-in tubing from the frontside port.

17. The formation test system of claim 14, wherein insertion of the drill-in tubing further includes, applying fluid pressure within the drill-in tubing from a fluid source.

18. A method for formation testing comprising:

positioning a formation test tool to a test location within a wellbore; and deploying a probe proximate a wellbore surface at the test location, wherein the probe includes drill-in tubing having an extensible front tip, said deploying the probe including, wherein a back end of the drill-in tubing is wound onto a spiral groove and supported on a tubing mandrel, wherein the tubing mandrel includes the spiral groove in its surface:

extending the drill-in tubing from the probe into the wellbore surface; and inducing vibration in the drill-in tubing during said extending the drill-in tubing.

19. The method of claim 18, wherein extending the drill-in tubing includes rotating the tubing mandrel by a motor.

20. The method of claim 19, further comprising:

applying fluid pressure within the drill-in tubing during said extending the drill-in tubing detecting fluid pressure within the drill-in tubing; and wherein said applying fluid pressure within the drill-in tubing comprises modulating one or more flow parameters of fluid within the drill-in tubing based, at least in part, on the detected fluid pressure.

21. The method of claim 18, further comprising modulating a frequency of the induced vibration based, at least in part, on detected resistance to the extending of the drill-in tubing.

22. The method of claim 18, further comprising:

detecting reflected acoustic waves during said extending the drill-in tubing; and determining formation properties based, at least in part, on the detected acoustic waves.

23. The method of claim 18, wherein said extending the drill-in tubing into the wellbore surface comprising extending the drill-in tubing through a mud cake layer and into formation material.

24. The method of claim 18, further comprising performing inflow testing including:

withdrawing fluid from the formation into the drill-in tubing; and measuring at least one of pressure and flow rate during or following said withdrawing fluid.

25. The method of claim 18, further comprising performing injection testing including:

injecting fluid from the drill-in tubing into the formation; and measuring pressure during or following said injecting fluid to determine a pressure transient.

* * * * *